United States Patent [19]

Valley

[11] Patent Number: 4,956,982

[45] Date of Patent: Sep. 18, 1990

[54] ANTI-THEFT DEVICE FOR GARMENTS

[76] Inventor: Jana Valley, 2301 Fairview Ave. E., #109, Seattle, Wash. 98102

[21] Appl. No.: 477,711

[22] Filed: Feb. 9, 1990

[51] Int. Cl.[5] ..... E05B 73/00

[52] U.S. Cl. ..... 70/59; 70/18

[58] Field of Search ..... 70/59, 57.1, 18, 14; 211/4, 7, 8, 9

[56] References Cited

U.S. PATENT DOCUMENTS

| | | | |
|---|---|---|---|
| 662,334 | 11/1900 | Appleby | 70/59 |
| 3,378,144 | 4/1968 | Webster | 211/4 |
| 3,885,674 | 5/1975 | Rosenberg et al. | 211/4 |
| 3,966,100 | 6/1976 | Nelson | 211/4 |
| 3,985,183 | 10/1976 | Fernbaugh | 211/7 |
| 4,069,691 | 1/1978 | Simpson | 70/59 |
| 4,260,063 | 4/1981 | Bennett et al. | 211/4 |
| 4,540,092 | 9/1985 | DeSantis | 211/4 |
| 4,598,827 | 7/1986 | Keifer | 211/4 |
| 4,683,729 | 8/1987 | Rogers | 70/58 |
| 4,685,572 | 8/1987 | Jamison | 211/4 |

*Primary Examiner*—Robert L. Wolfe

*Attorney, Agent, or Firm*—Joan H. Pauly

[57] ABSTRACT

Two rings (6, 8) are secured to opposite ends of an elongated chain (4). The rings (6, 8) slidably engage a pair of pivoted semicircular jaws (10, 12). The diameter ($D_2$) of the smaller ring (8) is sufficiently small to prevent the ring (8) from being slid off of the jaws (10, 12) over their free ends (14). The layer ring (6) freely slides on and off the jaws (10, 12). The free jaw ends (14) have alignable holes (20) for engaging a padlock (22). The device (2) may be used to secure a garment (50, 52) by extending the chain (4) through a sleeve of the garment (50, 52) and locking the jaws (10, 12) onto a chair arm (28), closet pole (34), or other strcture of similar girth. The device (2) may be folded and carried in a small pocket.

3 Claims, 2 Drawing Sheets

ANTI-THEFT DEVICE FOR GARMENTS

TECHNICAL FIELD

This invention relates to devices for securing garments against theft and, more particularly, to such a device which may be carried in a pocket or small purse and which engages the sleeve of a garment to secure it to a variety of structures.

BACKGROUND OF THE INVENTION

Garments, such as coats and jackets, are becoming increasingly expensive. At the same time, there is a persistent and possibly increasing risk of such garments being stolen from public places when the wearer has removed the garment and temporarily left it unattended. The use of checkrooms to protect valuable garments can be inconvenient. Moreover, not all restaurants, concert halls, and other places where expensive garments are likely to be worn have secure checkrooms This situation has led to a reluctance on the part of some people to wear their best garments to places where the garments may have to be left unattended. When the garments are worn, the concern for their security can significantly detract from the enjoyment of the wearer.

The applicant is unaware of any device which addresses the security problems described above. The patent literature includes a number of examples of garment security devices for use in retail establishments, but not of devices which are sufficiently portable, flexible, and easy to operate to be used by an individual in the type of situation described above. Garment security devices suitable for use in retail stores are disclosed in U.S. Pat. No. 3,378,144, granted Apr. 16, 1968, to N. E. Webster; U.S. Pat. No. 3,885,674, granted May 27, 1975, to T. Rosenberg et al.; U.S. Pat. No. 3,985,183, granted Oct. 12, 1976, to F. Fernbaugh; U.S. Pat. No. 4,069,691, granted Jan. 24, 1978, to B. W. Simpson; U.S. Pat. No. 4,260,063, granted Apr. 7, 1981, to A. Bennett et al.; U.S. Pat. No. 4,540,092, granted Sept. 10, 1985, to J. DeSantis; U.S. Pat. No. 4,598,827, granted July 8, 1986, to T. A. Keifer; and U.S. Pat. No. 4,685,572; granted Aug. 11, 1987, to T. Jamison. Each of these eight patents, except the Keifer patent, discloses a device which includes a sleeve-engaging chain or other elongated member. The Keifer device has an elongated cable with one end having an enlarged plastic button for engaging a button hole and another end which engages a lock device mounted on a stanchion.

The Jamison patent discloses an anti-theft device for coupling a garment hanger to a suspension rail from which a garment is suspended by the hanger. The device includes a block which is attached to the suspension hook of the hanger. The block has an upper portion which forms a fixed hook and is provided with a key-operated locking mechanism. A midportion of a movable arm is pivotably attached to the block. One end of a chain is slidably received onto the fixed hook. The other end is permanently attached to the block, or has a ring similar to the ring on the first end for receiving the fixed hook. The fixed hook engages the rail in the same manner as the hook of an ordinary hanger to suspend the garment from the rail.

U.S. Pat. No. 4,683,729, granted Aug. 4, 1987, to K. A. Rogers, discloses anti-theft apparatus for a riding saddle. The apparatus includes a tether and a lock ring. The lock ring has two hinged halves. The hinge is enclosed by a connector to which the tether is attached.

The free ends of the ring segments may be locked together and closely surround a saddle horn to permit the saddle to be tethered.

Webster and Bennett et al. disclose chains With one end permanently attached to a hanger and a second end that locks onto the hanger. Fernbaugh and DeSantis disclose an elongated member with one end that is attached to an overhead bar or rail. The other end of the Fernbaugh elongated member opens into a configuration in which it cannot be pulled back through the sleeve, or loops back and engages the rail. The other end of the DeSantis cable engages a lower security bar or loops back and engages the upper end. Rosenberg et al. disclose a chain having an upper end looped over a garment rack and an enlarged ring on the lower end to prevent it from being drawn through a sleeve. Simpson discloses a cable having one end attached to a hanger and a second end attached to a lock device mounted on a vertical support.

DISCLOSURE OF THE INVENTION

The subject of the invention is an anti-theft device for garments. The device comprises a flexible elongated member, first and second rings, and a pair of substantially semicircular jaws. The rings are secured to the opposite ends of the elongated member. The first ring has a first maximum diameter, and the second ring has a second maximum diameter smaller than the first maximum diameter. Each of the jaws tapers in width from a first end to a second end. The second ends of the jaws are permanently pivotably connected to each other. The first ends have lock engaging portions. The jaws are dimensioned to surroundingly receive an arm of a chair or a closet pole. The first maximum diameter is large enough to permit the first ring to slide over the first ends of the jaws. The second maximum diameter is large enough to permit the second ring to slide over the second ends of the jaws but sufficiently small to prevent the second ring from sliding over the first ends of the jaws. The second ring is slidably received onto the jaws. The device is foldable into a compact configuration to fit into a pocket of a garment.

The tapering configuration of the jaws and the relative sizes of the rings have the advantage of allowing the second smaller ring to be permanently attached to the jaws while retaining flexibility in the relative position of the second ring on the jaws. The permanent attachment of the second ring prevents accidental detachment of the elongated member from the jaws and simplifies use of the device. The larger first ring is removable from the jaws to allow the elongated member to be extended through the sleeve of a garment. The slidability of the second ring over the tapered ends of the jaws facilitates assembly of the device in addition to allowing the second ring to slide along a portion of the jaws after the device has been assembled. The preferred dimensioning of the maximum diameter of the second ring is such that the second ring is slidable along each of the jaws from the tapered end to a midportion of the jaw about halfway between the first and second ends of the jaw.

The lock engaging portions of the jaws may take various forms. In the preferred embodiment, the lock engaging portions comprise a hole extending through each of the first ends of the jaws. The holes are alignable for receiving the shackle of a padlock This arrangement is simple in structure and permits ready replacement of the lock used with the device. It also allows a lock to be conveniently attached to one of the holes to keep it readily available when the device is being carried.

The device of the invention solves the problem of the unmet need for a device for securing a garment against theft in a variety of situations. By means of the device, a garment may easily be secured to the arm of a chair, a closet pole, or any other structure with similar dimensions. The device of the invention may be carried in a pocket or a small purse and, therefore, may easily be kept available for use. The device is also unobtrusive and may be quickly and easily engaged and disengaged. The gripping of a structure by the jaws ensures that a lock securing the ends of the jaws together is always in an accessible position to allow quick removal of the garment by the owner. The simplicity of the structure of the device permits its economical manufacture and gives the device a high degree of reliability.

These and other advantages and features will become apparent from the detailed description of the best mode for carrying out the invention that follows.

BRIEF DESCRIPTION OF THE DRAWINGS

In the drawings, like element designations refer to like parts throughout, and.

BEST MODE FOR CARRYING OUT THE INVENTION

Figure 4:
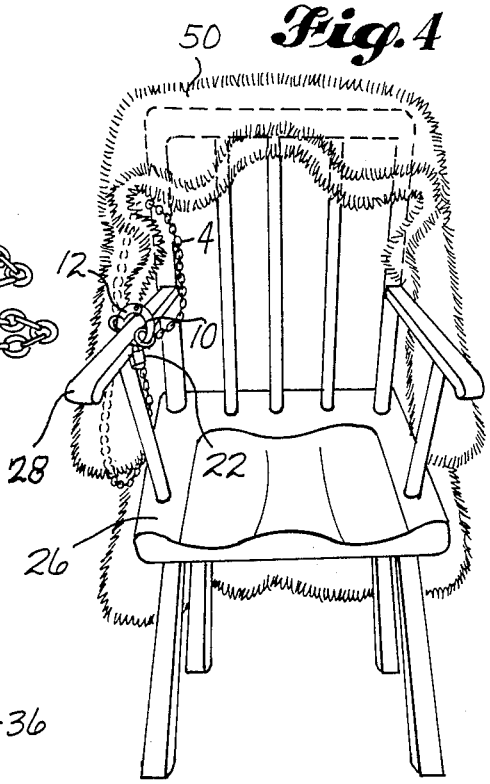
FIG. 4 is a pictorial view of the device in use to secure a coat to the arm of a chair.
Figure 5:
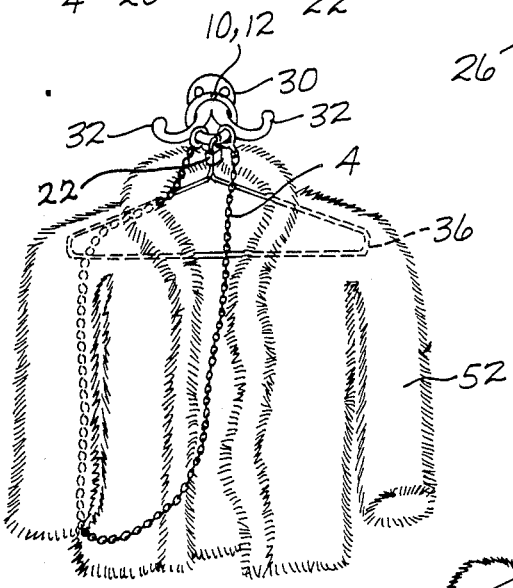
FIG. 5 is a pictorial view showing the device in use to secure a jacket to a double hook of a type commonly used in wall mounted clothes racks.
Figure 6:
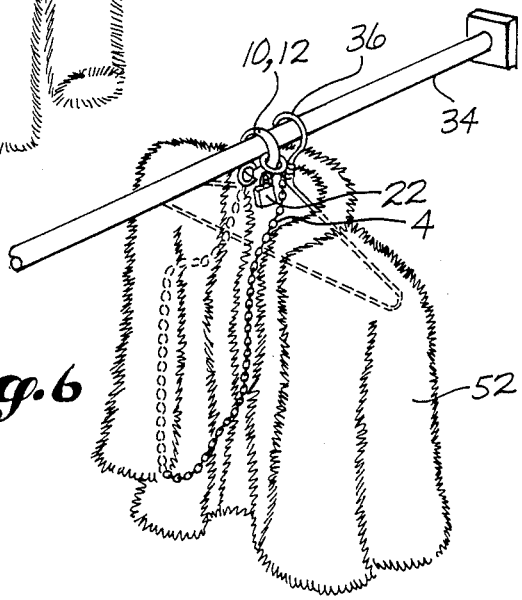
FIG. 6 is pictorial view illustrating the device in use to secure a jacket to a closet pole.

The drawings show an anti-theft device 2 that is constructed according to the invention and that also constitutes the best mode for carrying out the invention currently known to the applicant. FIGS. 4–6 illustrate the use of the device 2. These illustrated uses are only three examples of the wide variety of securing arrangements in which the versatile device of the invention may be used. In each of the illustrated uses, a sleeve of a garment is engaged. The device may also engage a leg or other opening in a garment.

The device 2 includes a flexible elongated member. In the illustrated preferred embodiment, the member is a chain 4. The chain 4 has welded links of a strong metal to prevent the links from being pried apart. First and second rings 6, 8 are secured to the respective ends of the chain 4. The first ring 6 has a first maximum diameter $D_1$. The second ring 8 has a second maximum diameter $D_2$. As shown, the rings 6, 8 are circular and have constant diameters $D_1$, $D_2$. However, the shape of the rings may be varied without departing from the spirit and scope of the invention. For example, the rings could be elliptical. Each of the rings 6, 8 is preferably welded to its respective end of the chain 4, as at 9. This provides a secure connection between the rings 6, 8 and chain 4 to maintain the security of the device 2.

Figure 1:
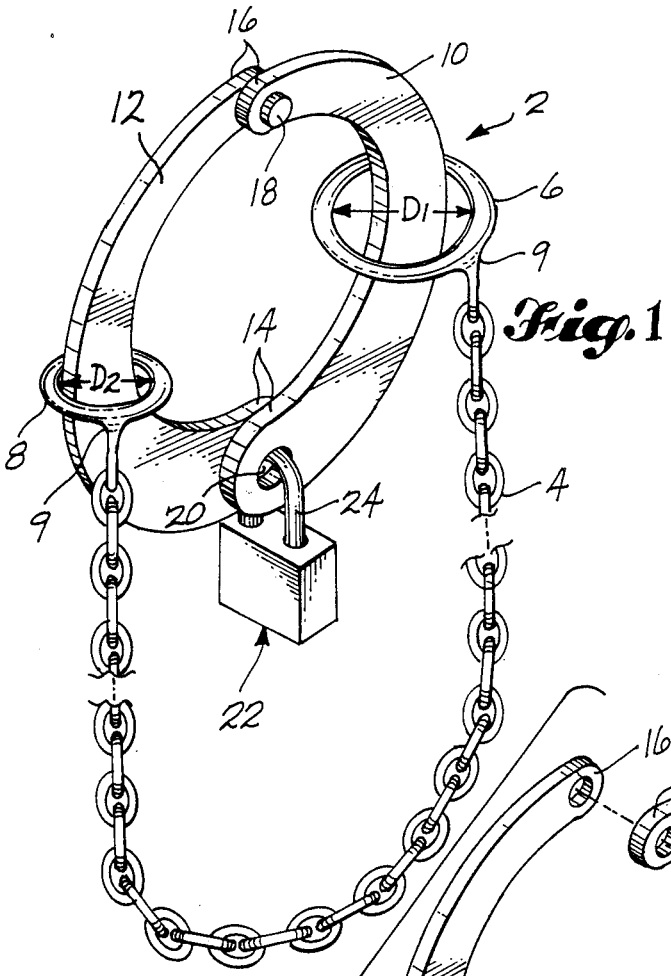
FIG. 1 is a pictorial view of the preferred embodiment of the device in an assembled and locked condition.

The device 2 also includes a pair of essentially identical jaws 10, 12. The jaws 10, 12 are flat and together form a circular outer periphery in the assembled locked device 2, as shown in FIG. 1. Each of the jaws 10, 12 is substantially semicircular but has a circumferential extent somewhat greater than 180° to permit the opposite ends 14, 16 of the jaws 10, 12 to overlap and be secured together. Each jaw 10, 12 tapers in radial width from a first end 14 to a second narrower end 16. In the assembled device 2, the second ends 16 are permanently pivotably connected to each other by a rivet 18. The first ends 14 have lock engaging portions In the illustrated preferred embodiment, these portions comprise a hole 20 extending through each of the first ends 14. The holes 20 are alignable with each other for receiving the shackle 24 of padlock 22, as shown in FIG. 1.

The rings 6, 8 are dimensioned to facilitate the assembly of the device 2, to maintain flexibility in the positioning of the rings 6, 8 on the jaws 10, 12 when the assembled device 2 is being used, and to cause the second ring 8 to be permanently attached to the jaws 10, 12 in the assembled device 2 and the first ring 6 to be removably and slidably receivable onto the jaws 10, 2. The maximum diameter $D_1$ of the first ring 6 is sufficiently large to permit the first ring 6 to slide over the first end 14 of either jaw 10, 12 when the first ends 14 are detached from each other. This allows the free end of the chain 4 to be freely engaged and disengaged from the jaws 10, 12 and to slide around the jaws 10, 12 when the jaws 10, 12 are locked together as shown in FIG. 1.

Figure 2:
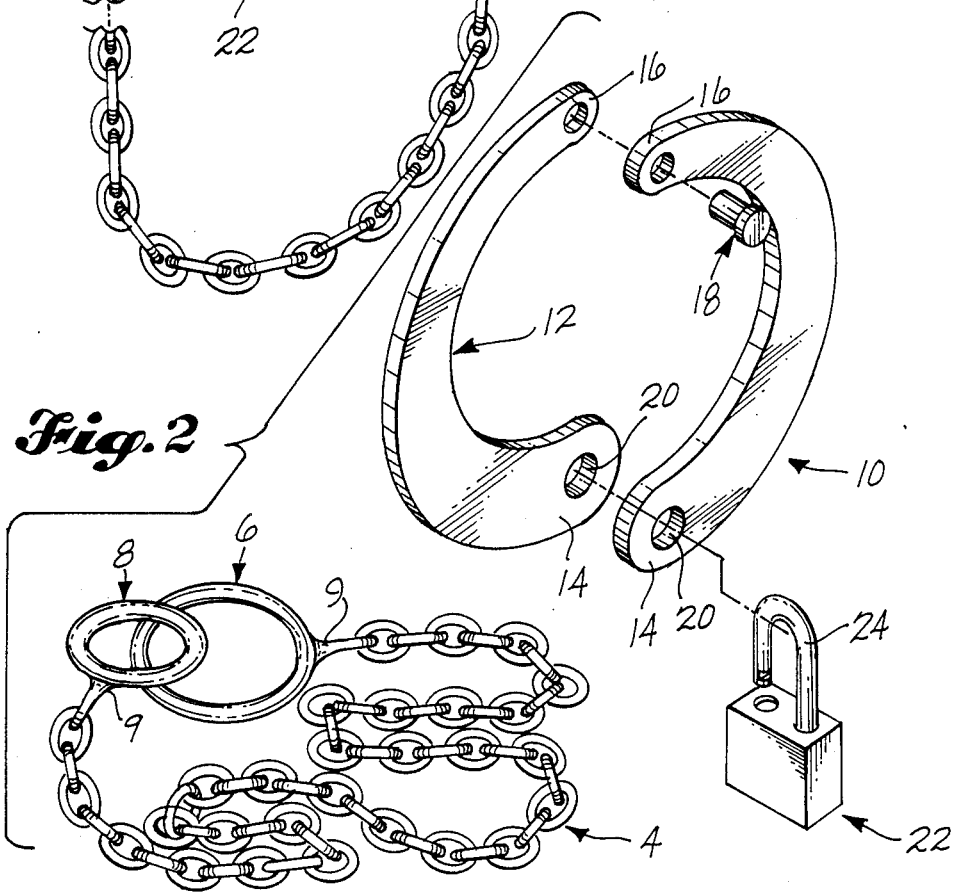
FIG. 2 is an exploded pictorial view of the device and lock shown in FIG. 1.

The maximum diameter $D_2$ of the second ring 8 is sufficiently large to permit the second ring 8 to slide over the second ends 16 of the jaws 10, 12 but sufficiently small to prevent the second ring 8 from sliding over the first jaw ends 14. This facilitates the assembly of the device 2 by permitting the second ring 6 to be slid onto one of the jaws 10, 12 when the jaws 10, 12 are in the disassembled condition shown in FIG. 2. After the ring 8 has been positioned on a jaw 10, 12, the rivet 18 is installed to attach the second jaw ends 16 together. This automatically permanently attaches the ring 8 to the jaws 10, 12. However, the ring 8 continues to be freely slidable around the portion of the connected jaws 10, 12 adjacent to the rivet 8. In the preferred dimensioning illustrated in the drawings, the second ring 8 is slidable along each jaw 10, 12 from the riveted end 16 to a midportion of the jaw 10, 12 about halfway between the first and second ends 14, 16.

Figure 3:
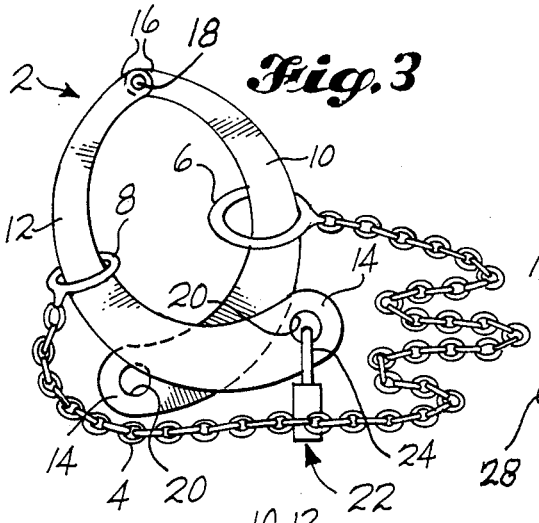
FIG. 3 is an elevational view of the device and attached lock in a folded configuration.

A significant feature of the device 2 is its capability of being folded into a compact configuration to fit into, for example, a pocket of a garment. The folded configuration is illustrated in FIG. 3. When the chain 4 is gathered together and the jaws 10, 12 are folded as shown in FIG. 3, the device 2 easily fits into a relatively small pocket. It is anticipated that a suitable carrying pouch will be provided with the device 2 to facilitate carrying it in a purse. An example of the folded size of the device is 4 inches by 3½ inches by 1 inch. A chain length of 24 inches is presently considered to be about optimal. This length allows the chain to be received through the sleeve of a garment to attach the garment to a chair arm with minimal, if any, gathering of the sleeve.

When the jaws 10, 12 are in their closed locked position shown in FIG. 1, they define an essentially circular opening dimensioned to surroundingly receive an arm 28 of a chair 26, a closet pole 34, or other structure of similar girth. The semicircular configuration of the jaws 10, 12 and their end pivotal connection allows them to open fully and receive any member with a girth no greater than the center opening defined by the jaws 10, 12. FIGS. 4–6 illustrate three examples of the use of the device 2. In FIG. 4, the device 2 is shown extending through the sleeve of a coat 50 draped over the back of a chair 26. The jaws 10, 12 are locked onto the arm 28 of the chair 26 to secure the coat 50 to the chair 26. In this type of use, a portion of the coat 50 may be draped over the device 2 to decrease its visibility. The slidability of the rings 6, 8 on the jaws 10, 12 allows the positions of the rings 6, 8 to automatically adjust so that the device hangs neatly and unobtrusively from the chair arm 28.

FIGS. 5 and 6 illustrate uses of the device 2 in situations in which a garment is hung on a hanger 36. In FIG. 5, a jacket 52 is shown hanging on and secured to a fixture 30 having two hooks 32. This type of fixture 30 is commonly used in wall mounted coat racks. In FIG. 6, the device 2 is shown securing the jacket 52 to the type of closet pole 34 commonly provided for receiving garment hangers of a standard type.

Although the preferred embodiment of the invention has been illustrated and described herein, it is intended to be understood by those skilled in the art that various modifications and omissions in form and detail may be made without departing from the spirit and scope of the invention as defined by the following claims.

What is claimed is:

1. An anti-theft device for garments, comprising:

a flexible elongated member having opposite ends;

first and second rings secured to said opposite ends, respectively; said first ring having a first maximum diameter, and said second ring having a second maximum diameter smaller than said first maximum diameter; and a pair of substantially semicircular jaws; each said jaw having first and second opposite ends and tapering in width from said first end to said second end, said second ends being permanently pivotably connected to each other, and said first ends having lock engaging portions; and said jaws being dimensioned to surroundingly receive an arm of a chair or a closet pole;

said first maximum diameter being sufficiently large to permit said first ring to slide over said first ends, and said second maximum diameter being sufficiently large to permit said second ring to slide over said second ends but sufficiently small to prevent said second ring from sliding over said first ends; and said second ring being slidably received onto said jaws; and said device being foldable into a compact configuration to fit into a pocket of a garment.

2. The device of claim 1, in which said second ring is slidable along each said jaw from said second end to a midportion of said jaw about halfway between said first and second ends.

3. The device of claim 1, in which said lock engaging portions comprise a hole extending through each of said first ends, said holes being alignable for receiving the shackle of a padlock.

* * * * *

UNITED STATES PATENT AND TRADEMARK OFFICE

CERTIFICATE OF CORRECTION

PATENT NO. : 4,956,982

DATED : September 18, 1990

INVENTOR(S) : Jana Valley

It is certified that error appears in the above-identified patent and that said Letters Patent is hereby corrected as shown below:

ON THE TITLE PAGE

Under item [19] "Valley" should read --Valley--; and

Item [76] Inventor: "Valley" should read --Vallely--.

Col. 1, line 20, there should be a period after "checkrooms".

Col. 2, line 4, "With" should be -- with --.

Col. 2, line 67, there should be a period after "padlock".

Col. 4, line 12, there should be a period after "portions".

Col. 4, line 44, "rivet 8" should be -- rivet 18 --.

Signed and Sealed this

Fourth Day of February, 1992

*Attest:*

HARRY F. MANBECK, JR.

*Attesting Officer*

*Commissioner of Patents and Trademarks*